US005967915A

United States Patent [19]

Lu et al.

[11] Patent Number: 5,967,915

[45] Date of Patent: Oct. 19, 1999

[54] DART

[76] Inventors: Kuo-Hui Lu, 3f, No. 50, Lane 2, Sec. 2, Yan Jiow Yuann Rd., Taipei, Taiwan; Ching-Tai Yen, 4f, No. 11, Lane 474, Kang-Ning St., Hsi Chih, Taipei Hsien, Taiwan

[21] Appl. No.: 09/026,342

[22] Filed: Feb. 19, 1998

[51] Int. Cl.[6] ..... A63B 65/02

[52] U.S. Cl. ..... 473/578; 473/582

[58] Field of Search ..... 473/578, 582, 473/FOR 216, FOR 219

[56] References Cited

U.S. PATENT DOCUMENTS

| | | | |
|---|---|---|---|
| 5,009,433 | 4/1991 | Reid | 473/582 |
| 5,114,156 | 5/1992 | Saunders | 473/582 |
| 5,498,004 | 3/1996 | Mariella et al. | 473/578 |
| 5,562,291 | 10/1996 | Garcia | 473/582 |

FOREIGN PATENT DOCUMENTS

| | | | |
|---|---|---|---|
| 2224452 | 5/1990 | United Kingdom | 473/FOR 219 |

*Primary Examiner*—John A. Ricci

*Attorney, Agent, or Firm*—Varndell Legal Group

[57] ABSTRACT

A dart having a shaft with a flight, a tip member, and a metal barrel connected between the shaft and the tip member, wherein the tip member has a rigid, cylindrical, solid core, and a hollow cylindrical shell receiving the rigid core, the hollow cylindrical shell having an outer thread at the rear end thereof threaded into a screw hole on one end of the metal barrel, a plurality of recessed portions equiangularly spaced around the periphery of the front end thereof, and a plurality of toothed annular portions raised around the periphery and arranged in parallel between the recessed portions and the outer thread for positioning in studs on a dart board, the recessed portions having a water drop-like shape and a depth gradually reduced from the front end of the cylindrical shell toward the toothed annular portions for guiding the tip member into engagement with the studs on the dart board.

4 Claims, 4 Drawing Sheets

DART

BACKGROUND OF THE INVENTION (a) Field of the Invention

The present invention relates to a dart for the game of darts, and more particularly to such a dart which has toothed annular portions raised around the periphery of the tip member thereof for positioning in between studs on a dart board by friction.

(b) Description of the Prior Art

FIG. 1 shows a dart according to the prior art. This structure of dart is comprised of a shaft integral with a flight, and a barrel integral with a point. Because the point 10 of the barrel 20 has a smooth outside surface, the dart tends to drop from the dart board due to vibration. Further, if the point of the barrel directly hits the ends of the studs on the dart board, the studs tend to be damaged.

SUMMARY OF THE INVENTION

The present invention provides a dart which eliminates the aforesaid drawbacks. According to one embodiment of the present invention, the dart is comprised of a shaft with a flight, a tip member, and a metal barrel connected between the tip member and the shaft, wherein the tip member comprises a rigid, cylindrical, solid core, and a hollow cylindrical shell receiving the rigid core, the hollow cylindrical shell having an outer thread at the rear end thereof threaded into a screw hole on one end of the metal barrel, a plurality of recessed portions equiangularly spaced around the periphery of the front end thereof, and a plurality of toothed annular portions raised around the periphery and arranged in parallel between the recessed portions and the outer thread for positioning in studs on a dart board, the recessed portions having a water drop-like shape and a depth gradually reduced from the front end of the cylindrical shell toward the toothed annular portions for guiding the tip member into engagement with the studs on the dart board without damaging the studs. The toothed annular portions have a smoothly curved outer side, and a diameter greater than the pitch between two studs on the dart board. Therefore, when the tip member is inserted in between two studs on the dart board, a friction resistance is produced between the studs and the toothed annular portions, causing the dart to be firmly retained in place. According to an alternate form of the present invention, the tip member is a solid member molded from flexible material, having an outer thread at a rear end thereof threaded into the screw hole on one end of the metal barrel, a plurality of recessed portions equiangularly spaced around a front end thereof remote from the metal barrel, and a plurality of toothed annular portions raised around the periphery thereof and arranged in parallel between the recessed portions and the outer thread, the recessed portions having a water drop-like shape and a depth gradually reduced from the front end of the cylindrical shell toward the toothed annular portions for guiding the tip member into engagement with the studs on the dart board.

DETAILED DESCRIPTION OF THE PREFERRED EMBODIMENT

Figure 1:
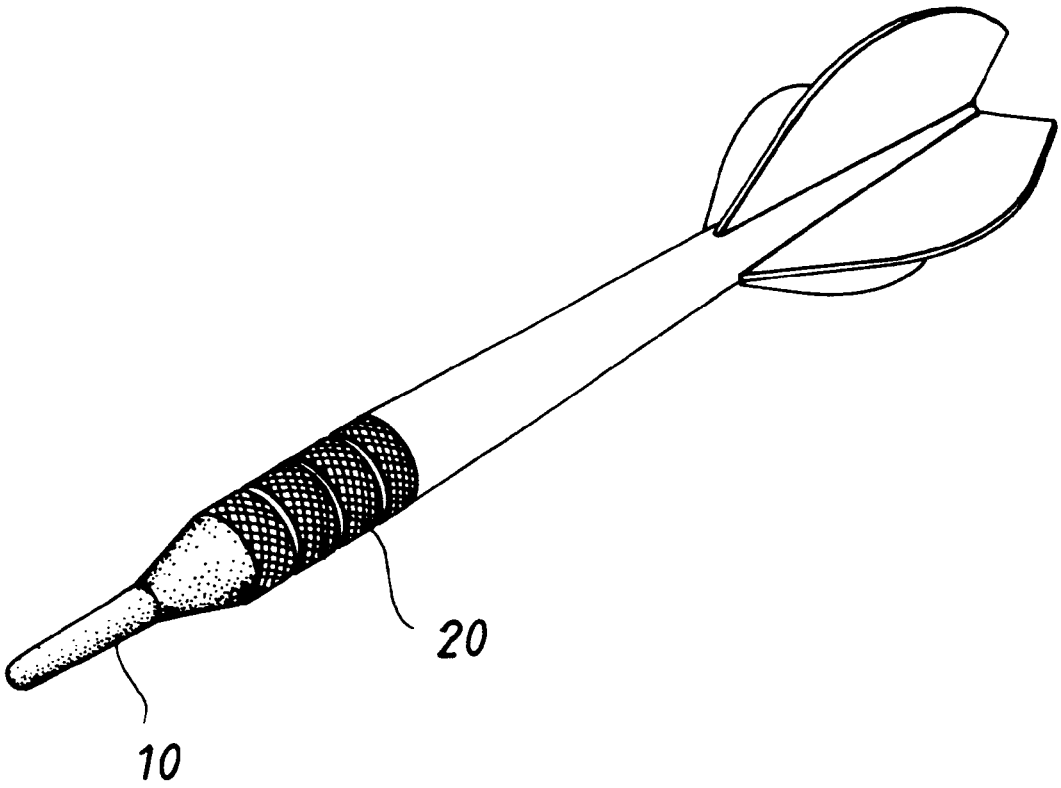
FIG. 1 is a perspective view of a dart according to the prior art.
Figure 2:
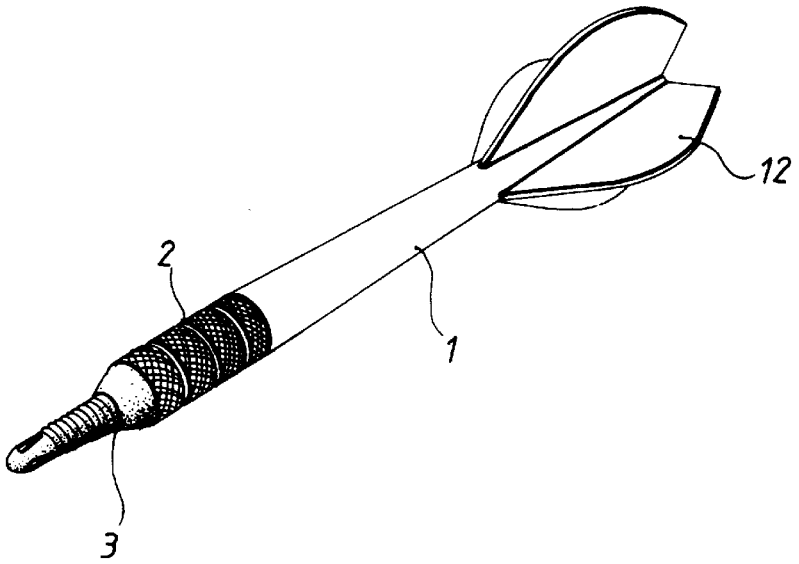
FIG. 2 is a perspective view of a dart according to the present invention.
Figure 3:
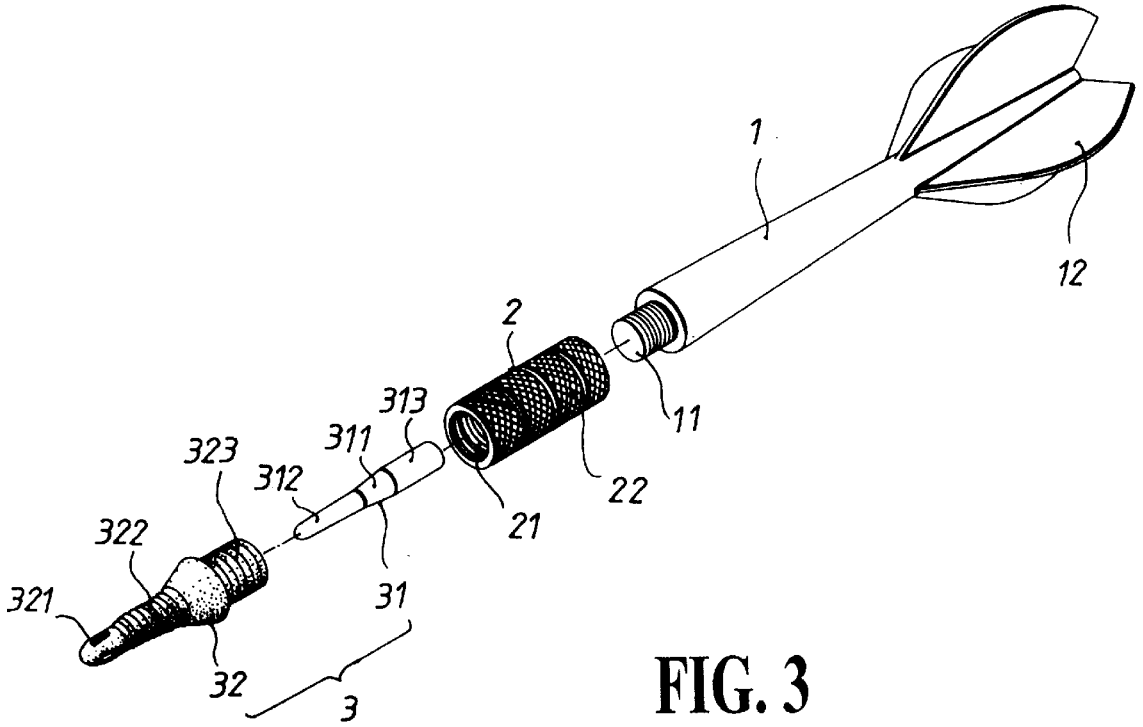
FIG. 3 is an exploded view of the dart shown in FIG. 2.

Referring to FIGS. 2 and 3, a dart in accordance with the present invention is generally comprised of a shaft 1, a barrel 2, and a tip member 3.

Referring to FIG. 3, the shaft 1 is integral with an axially extended screw rod 11 at one end, and a flight 12 at an opposite end.

Referring to FIG. 3, the barrel 2 is made from metal (for example copper), having two screw holes 21 at two opposite ends thereof for connection between the shaft 1 and the tip member 3, and an embossed outside wall 22.

Figure 4A:
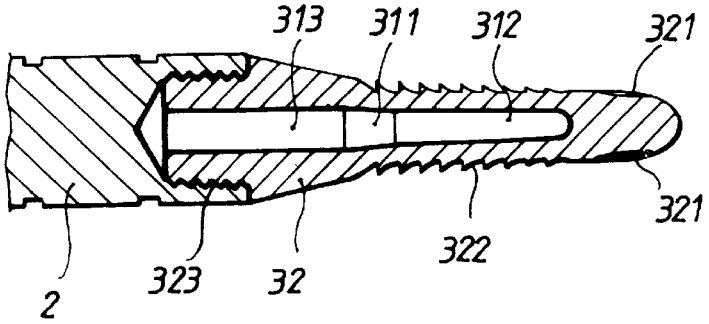
FIG. 4A is a sectional view in an enlarged scale of the front part of the dart shown in FIG. 1.
Figure 4B:
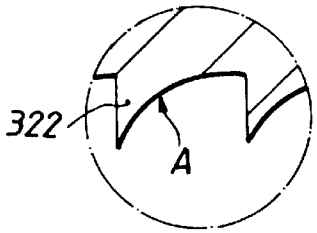
FIG. 4B is an enlarged view of a part of FIG. 4A, showing the structure of the toothed annular portions.

Referring to FIGS. 4A and 4B and FIG. 3 again, the tip member 3 is comprised of a rigid cylindrical core 31, and a cylindrical shell 32 receiving the rigid core 31. The core 31 is a solid member made from rigid plastics, having a cylindrical front extension section 312, a cylindrical rear extension section 313, and a tapered middle section 311 axially connected between the cylindrical front extension section 312 and the cylindrical rear extension section 313. The diameter of the tapered middle section 311 reduces gradually from the cylindrical rear extension section 313 toward the cylindrical front extension section 312. The core 31 is inserted into the cylindrical shell 32, and secured in place by a friction resistance produced between a tapered inside wall inside the cylindrical shell 32 and the outside wall of the tapered middle section 311 of the core 31. The middle section 311 may have a different design. If the design of the middle section 311 is changed, the inside wall of the cylindrical shell 32 must be relatively changed. The cylindrical shell 32 is a hollow shell made from flexible material. The inside space of the cylindrical shell 32 is sufficient to receive the whole body of the core 31 on the inside. The cylindrical shell 32 comprises an outer thread 323 at the rear end thereof for threading into one screw hole 21 on the barrel 2, a plurality of recessed portions 321 equiangularly spaced around the front end thereof, and a plurality of toothed annular portions 322 raised around the periphery between the outer thread 323 and the recessed portions 321 and arranged in parallel, each toothed portion 322 having a smoothly curved outer side A (see FIG. 4B). The recessed portions 321 have a water drop-like shape, and a depth gradually reduces from the front end of the cylindrical shell 32 toward the toothed annular portions 322.

Figure 5:
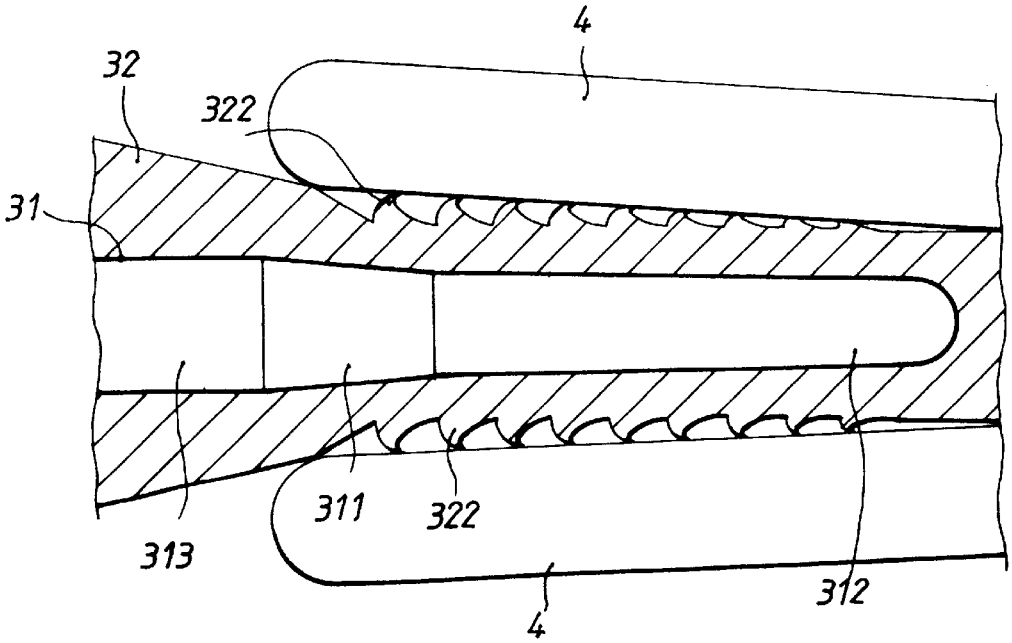
FIG. 5 is a schematic drawing showing the tip member retained between studs on a dart board according to the present invention.

Referring to FIG. 5, and Figures from 2 to 4B again, when the core 31 is fitted into the cylindrical shell 32, the outer thread 323 of the cylindrical shell 32 and the screw rod 11 of the shaft 1 are respectively threaded into the screw holes 21 at the two opposite ends of the barrel 2. When the dart is thrown into gaps among studs 4 on a dart board, the recessed portions 321 guide the dart into engagement with the studs 4, and a friction resistance is produced between the studs 4 and the toothed annular portions 322, thereby causing the dart to be firmly retained to the studs 4 on the dart board (see FIG. 5).

Figure 6:
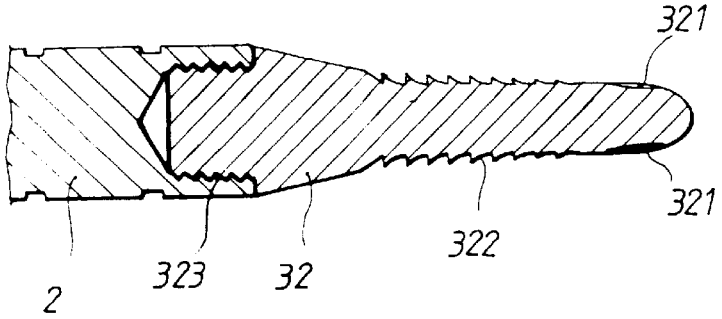
FIG. 6 is a sectional view of an alternate form of the tip member according to the present invention.

FIG. 6 shows an alternate form of the present invention which eliminates the aforesaid cylindrical core 31, and the cylindrical shell 32 is a solid, flexible member molded from rubber or plastics.

Figure 7:
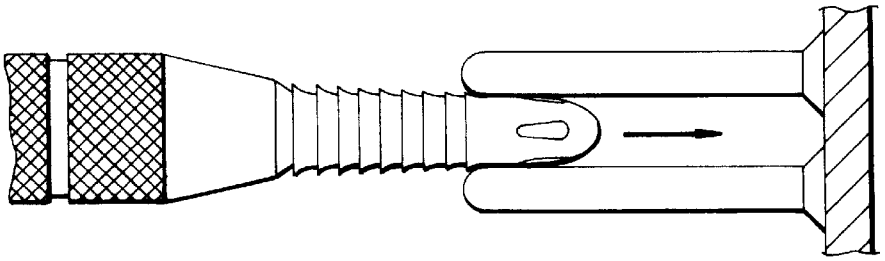
FIG. 7 shows the tip member of FIG. 6 inserted in between studs on a dart board.

FIG. 7 shows the dart of FIG. 6 inserted in gaps among studs on a dart board. Because the diameter of the toothed annular portions is greater than the pitch between each two adjacent studs on the dart board, the dart can be firmly retained in position after its insertion into gaps among studs on the dart board.

It is to be understood that the drawings are designed for purposes of illustration only, and are not intended as a definition of the limits and scope of the invention disclosed.

What the invention claimed is:

1. A dart comprising a metal barrel having a first screw hole and a second screw hole respectively disposed at two opposite ends thereof, a shaft having a screw rod integral with a front end thereof and threaded into the first screw hole on said metal barrel and a flight integral with a rear end thereof, and a tip member having an outer thread at one end threaded into the second screw hole on said metal barrel, wherein:

said tip member is comprised of a rigid, cylindrical, solid core, and a hollow cylindrical shell receiving said rigid core, said hollow cylindrical shell comprising an outer thread at a rear end thereof threaded into the second screw hole on said metal barrel, a plurality of recessed portions equiangularly spaced around a front end thereof remote from said metal barrel, and a plurality of toothed annular portions raised around the periphery thereof and arranged in parallel between said recessed portions and said outer thread, said recessed portions having a water drop-like shape and a depth gradually reduced from the front end of said cylindrical shell toward said toothed annular portions.

2. The dart of claim 1, wherein said toothed annular portions have a respective smoothly curved outer side.

3. The dart of claim 1, wherein said cylindrical shell has a tapered inside wall portion; said core has a tapered middle section connected between a cylindrical front section and a cylindrical rear section thereof and forced into engagement with the tapered inside wall portion inside said cylindrical shell.

4. A dart comprising a metal barrel having a first screw hole and a second screw hole respectively disposed at two opposite ends thereof, a shaft having a screw rod integral with a front end thereof and threaded into the first screw hole on said metal barrel and a flight integral with a rear end thereof, and a tip member, wherein said tip member comprises an outer thread at a rear end thereof threaded into the second screw hole on said metal barrel, a plurality of recessed portions equiangularly spaced around a front end thereof remote from said metal barrel, and a plurality of toothed annular portions raised around the periphery thereof and arranged in parallel between said recessed portions and said outer thread, said recessed portions having a water drop-like shape and a depth gradually reduced from the front end of said cylindrical shell toward said toothed annular portions.

* * * * *